US005779159A

United States Patent [19]

Williams et al.

[11] Patent Number: 5,779,159

[45] Date of Patent: Jul. 14, 1998

[54] ADDITIVE FLUID PERIPHERAL CHANNELING FIRE FIGHTING NOZZLE

[76] Inventors: Leslie P. Williams, deceased, late of Vidor, Tex.; by Dwight Williams, 1530 Texla Rd., Vidor, Tex. 77662

[21] Appl. No.: 512,965

[22] Filed: Aug. 9, 1995

[51] Int. Cl.[6] ..... B05B 7/06

[52] U.S. Cl. ..... 239/424.5; 239/432

[58] Field of Search ..... 239/419.3, 419.5, 239/424.5, 424, 432; 169/14, 15, 70

[56] References Cited

U.S. PATENT DOCUMENTS

| | | | |
|---|---|---|---|
| 2,003,184 | 5/1935 | Friedrich | 169/15 X |
| 3,693,884 | 9/1972 | Snodgrass et al. | 239/432 X |
| 3,836,076 | 9/1974 | Conrad et al. | 169/15 X |
| 4,143,717 | 3/1979 | Gagliardo et al. | 169/15 |
| 4,640,461 | 2/1987 | Williams | 239/432 X |
| 5,012,979 | 5/1991 | Williams | 239/424.5 X |
| 5,014,790 | 5/1991 | Papavergos | 169/15 X |

*Primary Examiner*—Lesley D. Morris

*Attorney, Agent, or Firm*—Sue Z. Shaper; Butler & Binion, L.L.P.

[57] ABSTRACT

A fire fighting nozzle wherein an additive fluid, such as foam concentrate or other liquid or gas, is supplied to a fluid passageway located peripherally along portions of a nozzle barrel wall and is discharged proximate the barrel discharge end, and preferably including educting the additive fluid into the nozzle using flow of the liquid through the barrel.

28 Claims, 5 Drawing Sheets

FIG. 2A
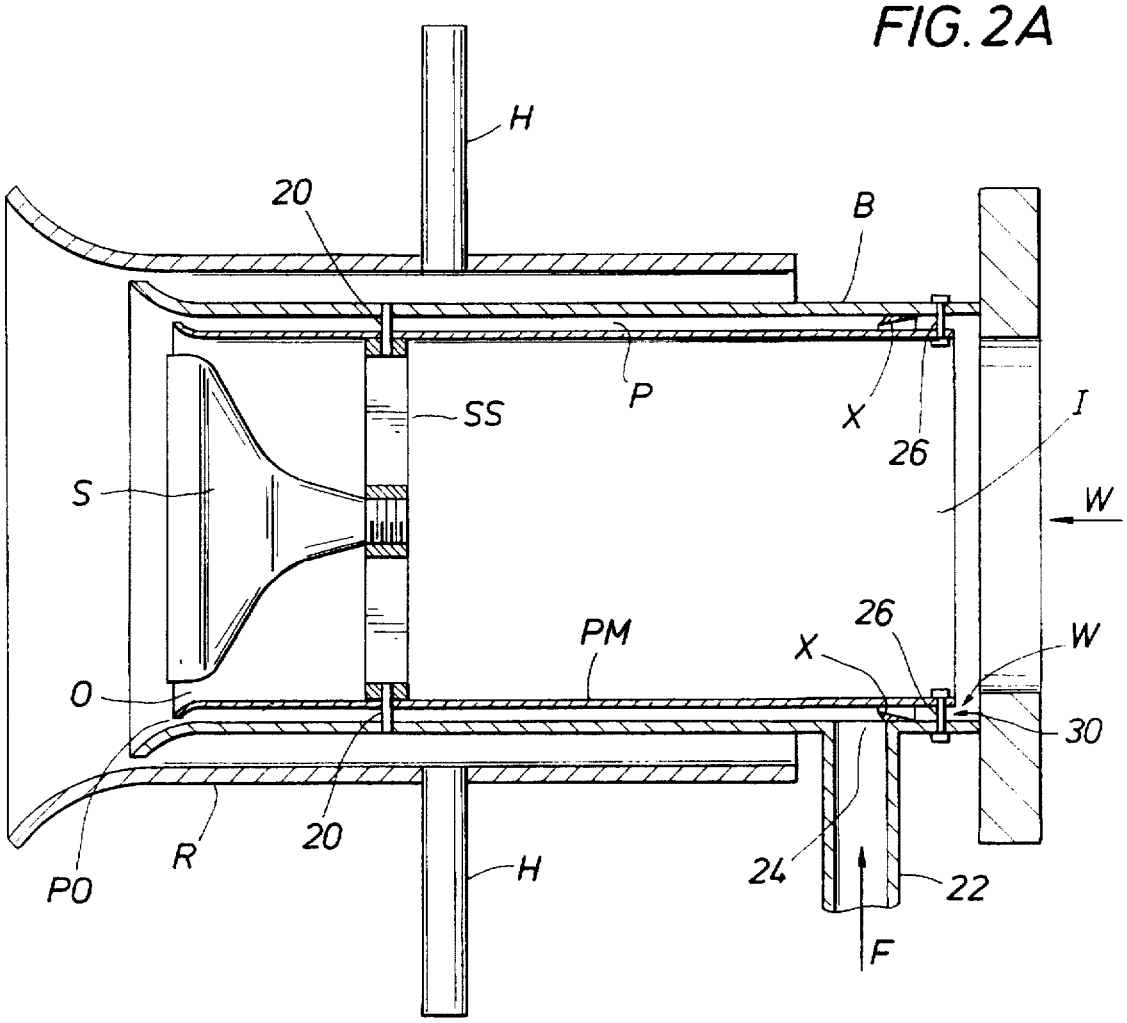
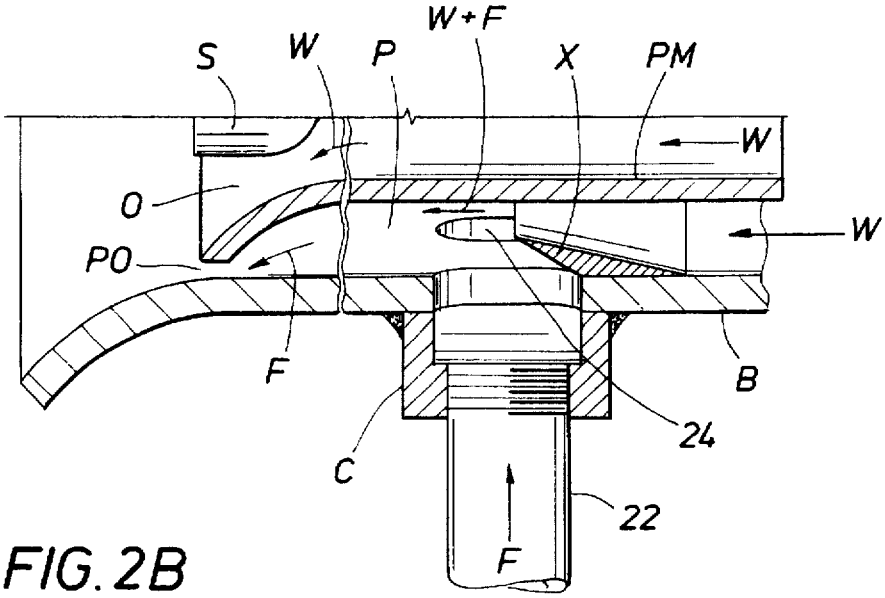
FIG. 2B

FIG. 3A
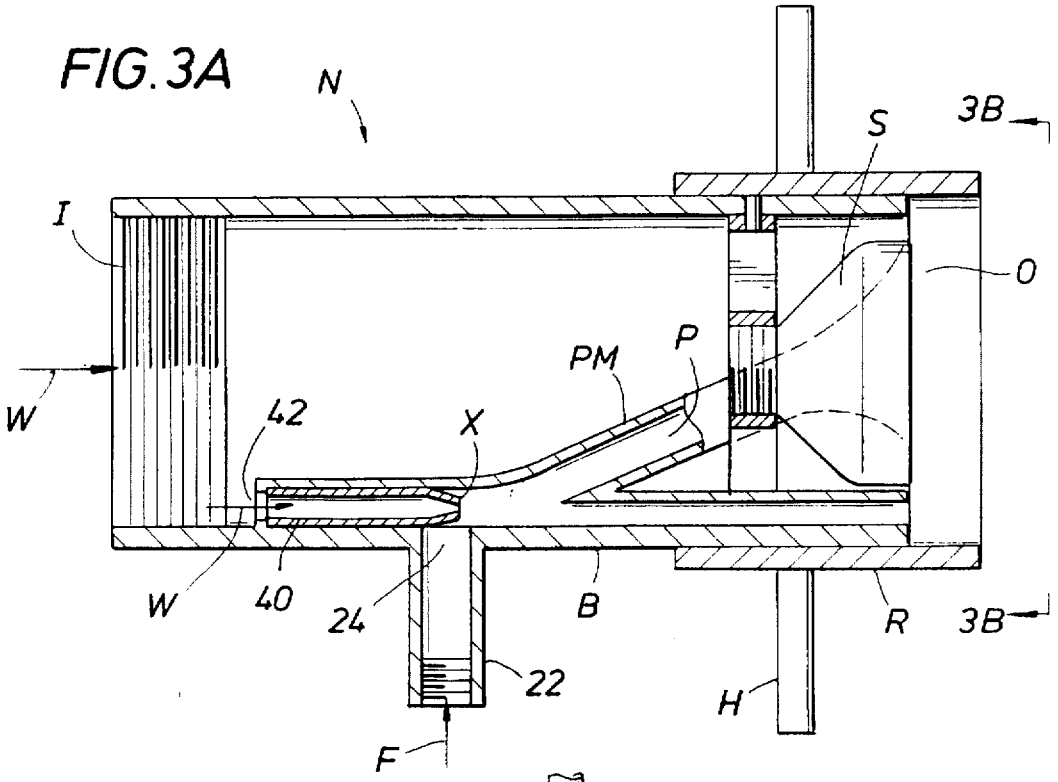
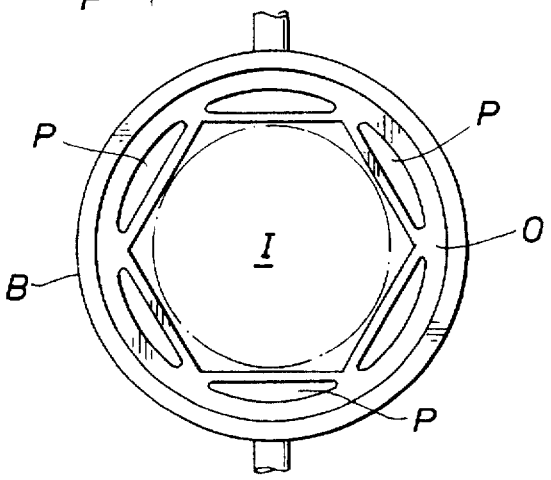
FIG. 3B
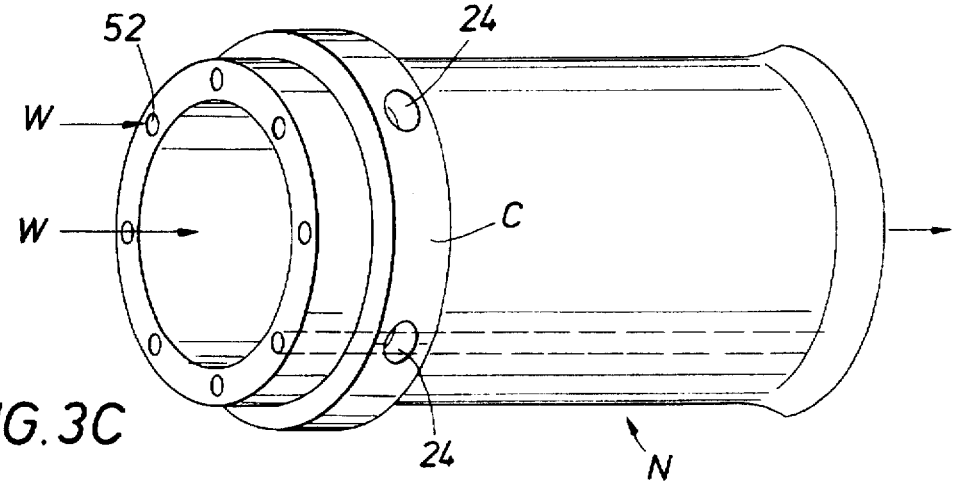
FIG. 3C

FIG. 4A
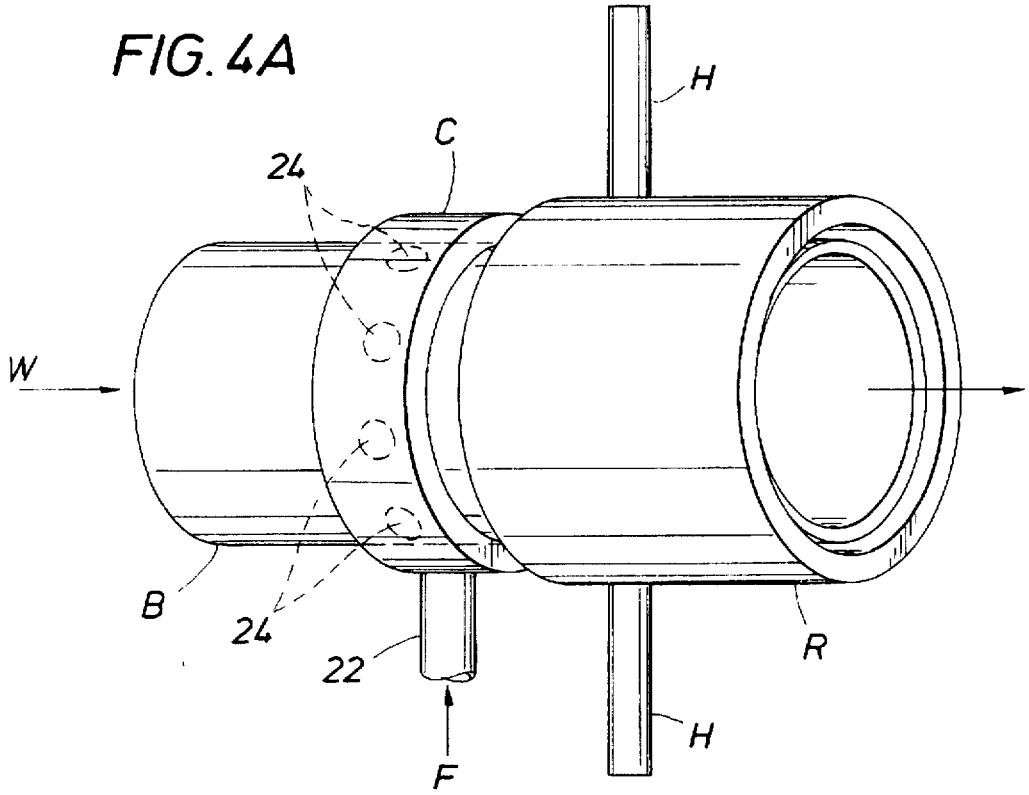
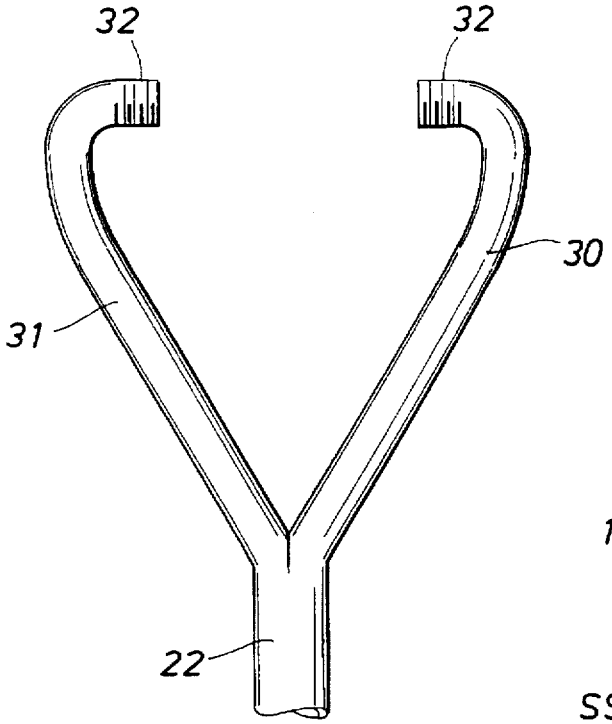
FIG. 4B
FIG. 4C
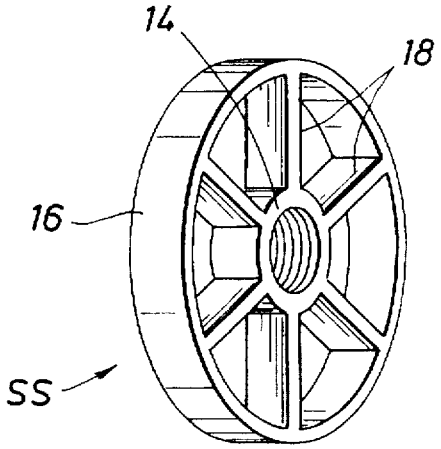

ADDITIVE FLUID PERIPHERAL CHANNELING FIRE FIGHTING NOZZLE

FIELD OF INVENTION

This invention relates to fire fighting nozzles, and in particular, to a fire fighting nozzle incorporating peripheral channeling for an additive fluid.

BACKGROUND OF INVENTION

The present invention comprises a variation to a fire fighting nozzle disclosed in U.S. Pat. No. 4,640,461, herein incorporated by reference. The '461 patent discloses a foam-applying fire fighting nozzle.

The '461 patent, in particular, describes a fire fighting nozzle intended for educting a foam concentrate into the nozzle and discharging a foam concentrate liquid mixture towards a fire. The patent discloses an eductor located within a nozzle barrel, the eductor discharging into a mixing chamber area defined at the barrel discharge end. In the mixing chamber area the foam concentrate is mixed with a primary liquid such as water flowing through the barrel. A deflecting plate assists in deflecting the foam concentrate toward the periphery of the barrel at the discharge end. An outer sleeve is provided for sliding engagement over the barrel to offer flow regulating means. Such outer sleeve serves to adjust the stream discharged from a straight stream pattern to a fog pattern, as is known in the art.

The present invention teaches an alternate method for supplying an additive fluid, be it foam concentrate, other liquids or gases such as inert gas or air, into a nozzle barrel and out the discharge end. The present invention provides for communicating such fluid in the nozzle along peripheral wall portions or channeling of the barrel. The additive fluid is discharged from peripherally located passageway outlet or outlets at the discharge end of the barrel where the fluid can mix with a primary fire fighting liquid, such as water.

An advantage offered by the design of the present invention is that a noticeable level of energy may be conserved in some circumstances by not redirecting additive fluids from central portions to peripheral portions of the barrel at a discharge end. Although foregoing possible advantages in the creation of a superior foam due to the heightened agitation incurred by deflecting a foam concentrate off of a deflecting plate, the present design may, in certain circumstances, justify such sacrifice to secure the advantage of a possibly enhanced range.

The nozzle of the present design is envisioned to have application not only with additive fluids such as fire fighting foam concentrates but also with other additive liquids or gases, such as inert gases or even air. The nozzle is useful with a primary fire fighting liquid such as water and/or with a premixed water and foam fire fighting liquid or with other fire fighting liquids. The nozzle can be useful for gas or air aspirating as well as for foam applying purposes.

SUMMARY OF THE INVENTION

The fire fighting nozzle design of the present invention includes a barrel having an inlet end and a discharge end. A stem is affixed within the barrel proximate the discharge end. A source of additive fluid is communicated to the barrel. A fluid passageway is defined along wall portions of the barrel, the defined passageway terminating at an outlet proximate the barrel discharge. The additive fluid is communicated to the peripheral passageway. The outlet may comprise an annular outlet or a plurality of outlets.

Preferably, means are provided for educting the additive fluid into the passageway. One source of eductive force can comprise affixing the stem with respect to the barrel discharge such that movement of liquid through the barrel past the stem creates a reduced pressure region proximate the passageway outlet. Another eductive force can be provided by means of a constriction in the passageway. Providing an opening for channeling a portion of a primary fire fighting liquid flowing through the barrel through the passageway and past the constriction, the constriction being located proximate an aperture in the passageway for communication with the source of additive fluid, can provide such other eductive force.

The nozzle may include an outer sleeve received for sliding reciprocation over the barrel. Such outer sleeve can regulate the shape of the discharge stream.

A plurality of stems or an adjustable stem can be provided for varying stem size and location vis-a-vis the barrel, thereby regulating not only the gallonage flow through the barrel but also one source of eductive force for the additive fluid.

The stem might be affixed within the barrel by means of a stream straightener.

The outlet, or outlets as the case may be, of the passageway is or are preferably distributed symmetrically around inside portions of the barrel wall.

In a preferred embodiment, a passageway is defined by means of an inner sleeve affixed within the barrel creating a passageway between the outside of the sleeve and the inside of the barrel wall. Alternately, however, the passageway could comprise a plurality of tubular-like passageways formed with or within or affixed to the barrel wall.

It is envisioned that the liquid flowing through the barrel could comprise, in particular, water or a mixture of water and foam concentrate. The additive fluid could comprise foam concentrate or other liquids or gases, including inert gases and air.

The invention also includes a method for fighting fires comprising attaching an inlet of a barrel to a source of liquid and attaching an aperture of the barrel to a source of an additive fluid. The method includes supplying the liquid to the barrel under pressure and educting additive fluid into a peripheral passageway around wall portions of the barrel. The method includes discharging the additive fluid at the peripheral passageway proximate discharging the liquid from the discharge end of the barrel.

BRIEF DESCRIPTION OF THE DRAWINGS

A better understanding of the present invention can be obtained when the following detailed description of the preferred embodiments is considered in conjunction with the following drawings, in which:

FIGS. 2A and 2B illustrate, schematically in section, a variation on the embodiment of FIG 1; FIG. 2B illustrates details of FIG. 2A.

FIGS. 3A and 3B illustrate, 3A schematically in section and 3B in schematic front elevation, a further embodiment of the present invention; in each the stem portion is illustrated by dotted lines for clarity.

FIG. 3C illustrates an embodiment that comprises a variation of the embodiment of FIG. 3A.

FIGS. 4A and 4B illustrate means for communicating additional fluid to the nozzle.

FIG. 4C illustrates a stream straightener.

DETAILED DESCRIPTION OF THE PREFERRED EMBODIMENTS

Figure 1:
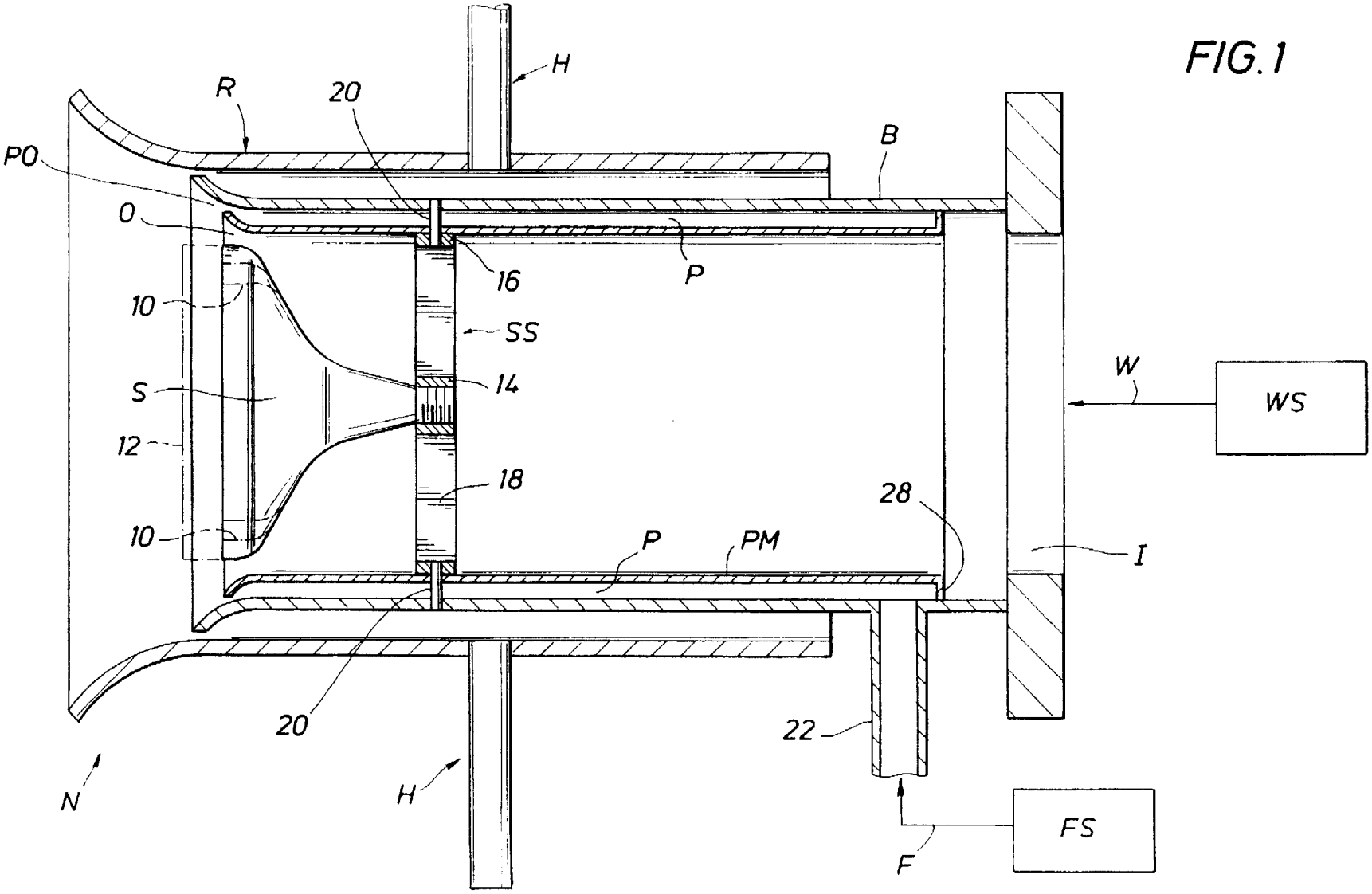
FIG. 1 illustrates, schematically in section, a preferred embodiment of the present invention.

FIG. 1 illustrates in schematic fashion a fire fighting nozzle N. Liquid, which could comprise water or water and foam or any other primary fire fighting liquid (but which will frequently be referred to hereafter as water W for convenience) is shown entering inlet I of nozzle N. Nozzle N comprises barrel B and is shown including outer sleeve R. Water W (or water and foam mixture W, or other liquid W) proceeds, in the drawing, from right to left and exits barrel B at discharge end O.

The flow regulating function of outer sleeve R is known by those in the art. Outer sleeve R may be telescoped outside of and over, barrel B, aided by handles H, in order to change the shape of the discharge from nozzle N. When outer sleeve R is extended, to the left in the drawing, off of barrel B, nozzle N tends to discharge its fluid in a straight stream pattern. When outer sleeve R is telescoped, to the right in the drawing, such that its overlap over barrel B is maximized, the stream discharged from nozzle N tends to assume a fog pattern.

Stem S is shown affixed within the interior of barrel B by means of stream straightener SS, proximate the discharge area end O of barrel B. Stem S forces liquid W entering inlet I of barrel B to exit barrel B in an annular pattern. Dashed lines 10 and 12, associated with stem S, are intended to indicate that stem S could have different diameters and different lengths with respect to barrel B. Such variations in size can be provided by utilizing a plurality of differently sized stems S, for example, that might screw into stream straightener SS, where stream straightener SS would be used as a means for attaching stem S to barrel B. Alternately, an adjustable stem S could be provided, having means for varying the stem's diameter and/or lateral length with respect to barrel B and means of attachment SS. Variations in the diameter and length and location of stem S can affect the gallonage of discharge as well as the discharge dynamics.

Means of attachment SS, and/or stream straightener SS more particularly illustrated in FIG. 4C, preferably includes an inner annular piece 14 for engagement with stem S. Stream straightener SS would also preferably include an outer annular ring 16, useful for attachment of the stream straightener to barrel B. Fins 18 preferably extend between piece 14 and ring 16 and connect inner ring 14 with outer ring 16. Fins 18 can be used to perform the additional function of assisting in "straightening the stream" of water or liquid W coursing through barrel B. Pins or screws or other means 20 can be utilized to attach stream straightener ring 16 to wall portions of barrel B.

Barrel B, as shown in FIG. 1, also has an inner sleeve PM that provides a passage defining means, defining an annular passageway between the exterior surface of inner sleeve PM and interior wall portions of barrel B. Such passageway P, in this case an annular passageway, provides a channel for the passage of additive fluid F through the barrel and out discharge outlet PO of passageway (or passageways) P.

Additive fluid F is shown being supplied through tube 22 that connects with barrel B. Fluid F passes through an aperture in the wall of barrel B, down passageway P and exits nozzle N at discharge outlet PO of passageway P. Discharge outlet PO is annular in the embodiment of FIG. 1, as is passageway P. FIG. 1 indicates that fluid F originates with a source of fluid FS, indicated in the drawing schematically. If fluid F were to comprise air, tube 22 could be quite short or dispensed with entirely. The source SF of fluid F in the case of air would be the ambient environment surrounding the inlet aperture in the barrel.

Figure 2A:
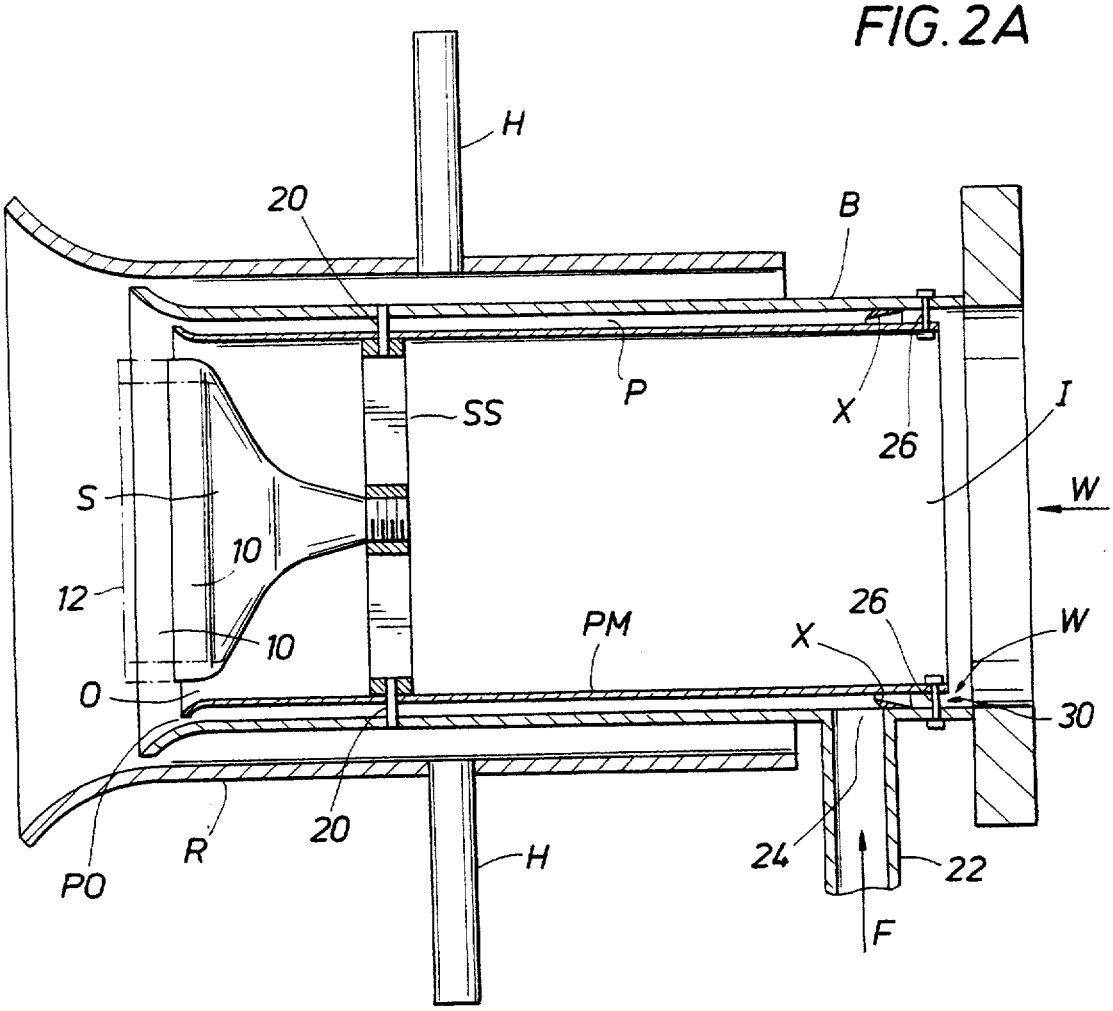

FIGS. 2A and 2B illustrate a variant on the embodiment of FIG. 1. In FIG. 1 as well as FIGS. 2A and 2B, passageway defining means PM comprises an inner sleeve affixed inside barrel B. Sleeve PM could be affixed by means of pins, screws or bolts 20 and 26, as illustrated in FIG. 1 and FIG. 2A. Whereas in FIG. 1 passageway P between sleeve PM and barrel B is illustrated as closed off, as near barrel inlet I by structural piece designated 28, FIG. 2A illustrates that sleeve PM may be open or partially open at inlet end I of barrel B. Opening 30, which well could be an annular opening, near inlet end I of barrel B, permits water or liquid W to enter passageway P. Downstream of opening 30 in passageway P, and proximate aperture 24 provided for additive fluid F into passageway P, as illustrated in FIG. 2A, arises constriction X. In FIG. 2A constriction X is illustrated as an annular constriction, such as a ridge. Water W flowing through opening 30 into passageway P will flow through the constricted area created by constriction X in passageway P and thence into a widened area of passageway P. Flow of the fluid W over constriction X and through the widened area of passageway P can create an educting force to educt fluid F through tube or communication means 22 and into passageway P.

A further eductive force can be created at the discharge end of barrel B, as illustrated in FIG. 1 and FIGS. 2A and 2B. As more clearly illustrated in FIG. 2B, water W exiting discharge end opening O of nozzle N between passage defining means PM and stem S is constricted by the placement of stem S vis-a-vis the barrel. Movement of liquid W exiting discharge end O may, by the relative location of stem S and outlet PO with respect to barrel B, create an educting force at outlet PO, tending to suck fluid F out of passageway P at the discharge end of barrel B.

Passageway means PM in FIGS. 1 and 2 preferably comprises an inner sleeve formed of a thin material such as steel. Barrel B as well as outer sleeve R would probably comprise thicker, cast metal pieces. Stem S might comprise a forged metal plug.

It can be appreciated that the embodiment illustrated in FIGS. 2A and 2B may provide double educting forces with regard to fluid F. While Fluid F might be a foam concentrate, it might also comprise another liquid or a gas, such as an inert gas, or even air. The usefulness and the effectiveness of any educting forces would be affected by the nature of the additive fluid F as well as by the nature of its means of communication from the fluid source and the nature of the primary liquid W.

FIG. 2B indicates, in a sectional schematic illustration, a segment of a cuff C that might be utilized to connect an additive fluid communicating tube 22 to an outside wall portion of barrel B. Such cuff could be useful if a plurality of annular holes or apertures 24 were provided around the wall of barrel B, as illustrated in FIG. 4A, for educting fluid F in a symmetrical fashion through annular wall portions of barrel B.

FIG. 4B illustrates an alternative means of communicating fluid F to barrel B. FIG. 4B illustrates tubular member 22 splitting into two split tubes 31, each capable of affixing to an outside portion of barrel B at tubular ends 32, presumably to attach to two separate holes or apertures 24 in the barrel wall.

Even if only one hole or aperture opening 24 is provided for the passage of fluid F through tube 22 into passageway P in barrel B, it is believed that most fluids F will move annularly around barrel B as they progress from the inlet end of barrel B toward the discharge end of barrel B. In such manner fluid F should substantially exit in an annular pattern from barrel B by the end of its travel, to the extent passageway outlets PO permit.

Figure 3B:
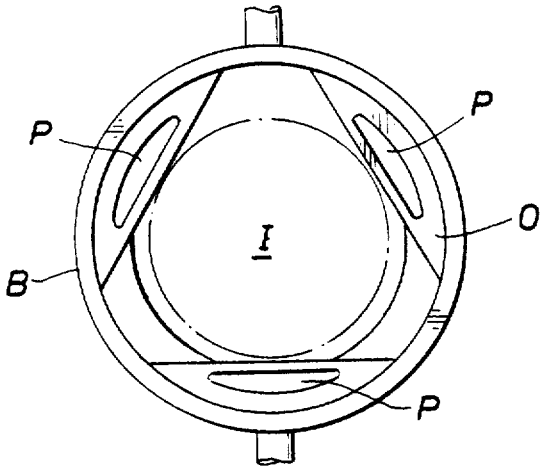
Figure 5:
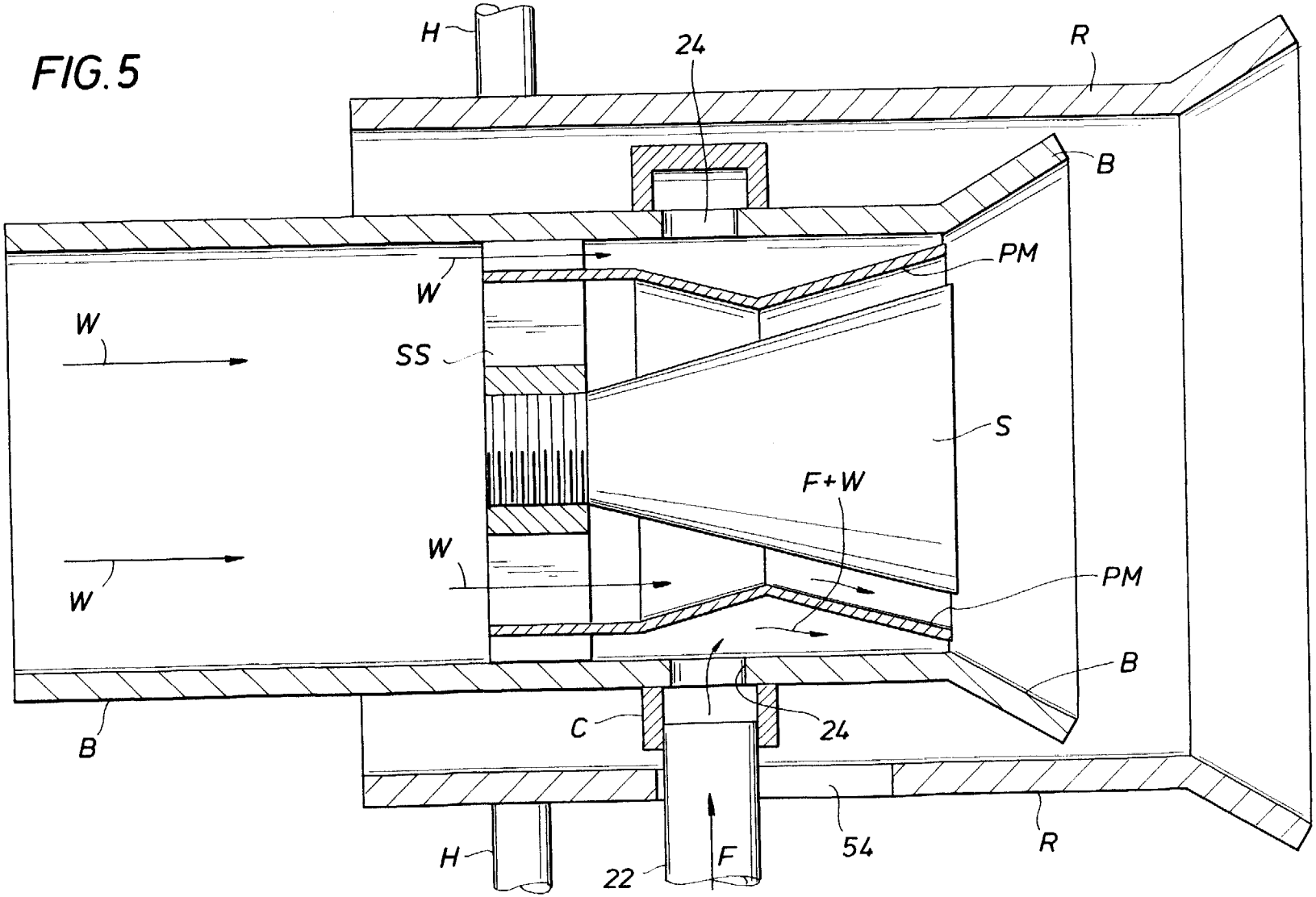

FIGS. 3A and 3B present a further alternate embodiment of the present invention. FIG. 3A illustrates a nozzle comprised of barrel B with outer sleeve R and having stem S affixed in the discharge end of barrel B. In the embodiment of FIG. 3A passageway means PM comprise vein-like tubes formed in or with inner wall portions of barrel B. Fluid F enters barrel B at opening 24. Water or other liquid W enters not only inlet I of barrel B but also opening 42 of passage means PM. Short tubular element 40 provides a point of constriction X for water or other liquid W, constriction X located proximate opening 24 for fluid F into barrel B. Constriction X enables water or other liquid W to apply educting forces on fluid F, educting fluid F through tubular means 22 into passageway P inside barrel B. Passageway P is shown diverting, dividing and expanding in a vein-like manner such that when passageway P terminates at the discharge end O of barrel B, passageway P has become a plurality of passageways providing radially symmetrical openings around the annular discharge end of barrel B. The termination of passageways P at outlets O of barrel B is illustrated by a schematic end view of barrel B provided in FIG. 3B. For clarity sake in FIGS. 3A and 3B, stem S is only indicated by dashed lines.

Passageway P could also be provided in barrel B by forming or casting a plurality of longitudinal channels in the wall itself of barrel B, as illustrated in FIG. 3C. Passage defining means PM as illustrated in FIG. 3A could be formed by attaching tubular-like pieces to inner portions of the wall of barrel B or by casting vein-like passage means PM in the wall of barrel B itself. Choice of the means of providing peripheral passageway P through barrel B could depend largely on manufacturing economies. Passageway P could open into an annular passageway outlet surrounding the discharge end of barrel B. Alternatively, passageway P could terminate in a discreet number of radially symmetrically placed outlets at the discharge end of barrel B.

The relative location of stem S with respect to the structure of the discharge end of barrel B and the placement of the discharge terminating outlets of passageway P will affect, among other factors, the educting power upon fluid F of the water or other liquid W passing through nozzle N and discharged at barrel end O. Such eductive power can be adjusted in accordance with the nature of fluid F and liquid W.

In operation, a source of primary fire fighting fluid, such as water or water and foam concentrate or other liquid, is connected to the inlet end and supplied under pressure to the fire fighting nozzle barrel. A source of additive fluid is connected to another opening or hole or aperture in the barrel wall, using appropriate fittings. If the additive fluid is simply air, no means of communication for connecting the barrel with any source of fluid may be necessary other than the aperture in the wall of the barrel.

The aperture or hole of the wall of the barrel provided for the inlet of additive fluid connects with a peripheral passageway(s) in the nozzle along the barrel wall. This passageway(s), as discussed above, may take any one of several forms. It may comprise a plurality of tubular type channels or holes. It may comprise an annular passageway, or a combination of both. The peripheral passageway should terminate proximate the discharge end of the barrel. The passageway or passageways, as the case may be, preferably terminates with opening outlets arranged radially symmetrically around the discharge outlet for uniform distribution of the additive fluid. The means of communication of the additive fluid is connected to a source of additive fluid. Water might comprise the primary fluid and foam concentrate, for a well recognized example, may comprise the additive fluid. Alternatively, a mixed water and foam concentrate may comprise the primary fluid and an inert gas or air could comprise the additive fluid. Air can always comprise an additive fluid for adding air aspiration.

The additive fluid is preferably educted into the nozzle, at least through the location and the structuring of the contours of the stem affixed within the nozzle at the discharge end, in conjunction with the barrel discharge opening and the shape and location of the passageway discharge outlets. A stem of appropriate diameter and length should be such that the primary fluid is directed to flow past the additive fluid discharge opening in a constricted-to-expanded channel to create a pressure drop over the discharge opening of the passageway for the additive fluid.

Alternatively, or in addition, eductor means can be arranged upstream in the barrel to assist sucking additive fluid into the barrel. For such eduction, the passageway can provide an upstream opening for the entrance of portions of the primary liquid and a constriction/expansion in the passageway can be provided in the path of the flow of the primary liquid, proximate the point of entrance of the additive fluid to the passageway. Flow of the primary liquid past the constriction/expansion proximate the additive fluid opening can be relatively oriented to create a drop in pressure over the additive fluid opening contributing a suction effect to educt additive fluid into the passageway of the barrel. Part or all of the motive force of the additive fluid can always be supplied externally, of course.

The outer sleeve of the barrel can be extended or retracted in order to create a straight stream pattern or a fog pattern to discharge fluids.

A certain amount of flow turbulence can be created or managed at the discharge end of the barrel which can enhance mixing of the additive fluid with the primary liquid as the fluids are discharged from the nozzle.

A preferred embodiment for the peripheral foam nozzle creates an annular passageway for the additive fluid, as by means of an inner sleeve affixed to and slightly spaced from the inner wall of the barrel. It is believed that with such design, additive fluids, even if ported into the annular passageway through a single opening in the barrel wall, will be subject to forces that tend to draw the fluid around the full circumference of the passageway.

Figure 5:
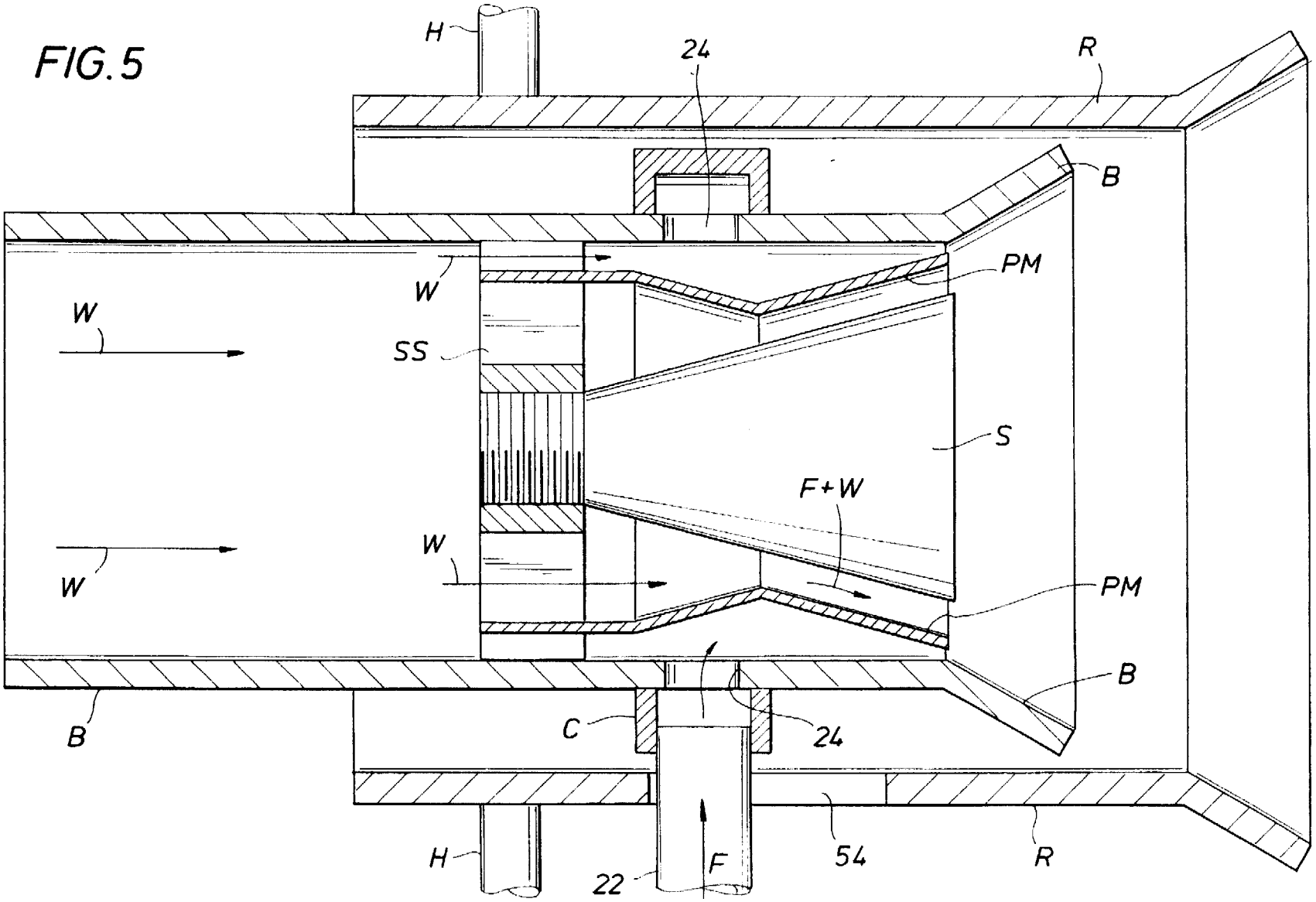
FIG. 5 illustrates a further embodiment of the present invention wherein the interior sleeve is shortened.
Figure 1:
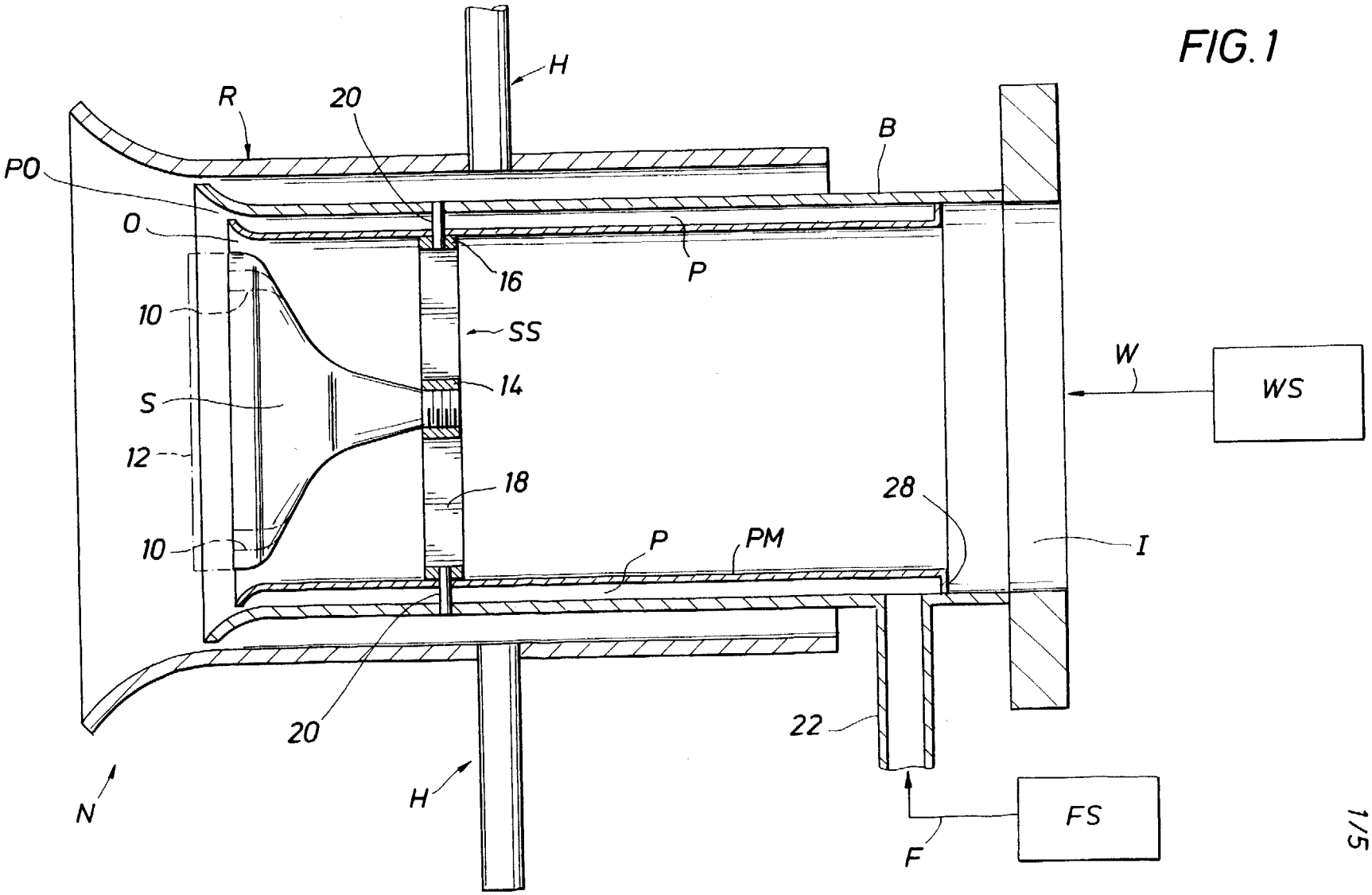

FIG. 5 illustrates a further embodiment of the present invention. In FIG. 5 the distance between the addition of the fluid F at the discharge end of barrel B has been shortened. For the purposes of FIG. 5, a slot 54 is provided in outer sleeve R to accommodate the necessity of tubing 22 to communicate with the location of aperture or apertures 24. Cuff C on barrel B located between barrel B and outer sleeve R is provided in order to introduce fluid F through at least two apertures 24 spaced around the wall of barrel B. In the embodiment of FIG. 5 stem S as well as sleeve PM is shown affixed to barrel B through stream straightener SS. As in FIG. 1 sleeve PM is shown providing an entrance for liquid W to flow past apertures 24. That flow path then preferably widens so as to provide an educting force on fluid F. Moving the inlet for fluid F closer to the discharge end O of barrel B serves to reduce the energy lost pumping fluid F over the resistance presented by the interior surface of the wall of barrel B and the exterior surface of the sleeve PM.

The foregoing disclosure and description of the invention are illustrative and explanatory thereof. Various changes in the size, shape and materials as well as the details of the illustrated construction may be made without departing from the spirit of the invention.

What is claimed is:

1. A fire fighting nozzle, comprising:

a barrel, having an inlet and a discharge, the barrel defining a passageway for a primary firefighting liquid;

a deflecting surface affixed within said barrel, proximate the discharge, positioned to outwardly deflect the primary liquid in the liquid passageway;

means for defining an additive fluid passageway along wall portions of said barrel, the means for defining an additive passageway terminating in an outlet proximate said barrel discharge; and wherein said deflecting surface and said outlet being positioned, in combination, such that liquid is deflected outwardly across said outlet.

2. The nozzle of claim 1 that includes means for educting an additive fluid into said additive passageway.

3. The nozzle of claim 1 wherein said deflecting surface comprises a surface of a stem affixed within said barrel.

4. The nozzle of claim 3 wherein said stem is positioned in said barrel such that a movement of liquid past said stem creates a reduced pressure region proximate said outlet.

5. The nozzle of claim 3 that includes interchangeable, variably sized stems.

6. The nozzle of claim 1 that includes means for removably affixing said stem in said barrel.

7. The nozzle of claim 3 wherein said stem is adjustable in size.

8. The nozzle of claim 1 wherein said means for defining an additive passageway defines an annular passageway.

9. The nozzle of claim 1 wherein said means for defining an additive passageway includes an inner sleeve affixed within said barrel.

10. The nozzle of claim 1 wherein said means for defining an additive passageway includes a plurality of tubularlike passageways.

11. The nozzle of claim 1 wherein said means for defining an additive passageway includes longitudinal channels in wall portions of said barrel.

12. The nozzle of claim 1 wherein said means for communicating an additive includes an aperture in a barrel wall portion communicating with said means for defining an additive passageway.

13. The nozzle of claim 12 that includes a plurality of said apertures.

14. The nozzle of claim 13 wherein said means for communicating fluid includes a cuff attachable around an outside portion of said barrel.

15. The nozzle of claim 1 wherein said additive fluid comprises foam concentrate.

16. The nozzle of claim 1 wherein said additive fluid comprises a liquid.

17. The nozzle of claim 1 wherein said additive fluid comprises a gas.

18. The nozzle of claim 1 wherein said additive fluid comprises air.

19. The nozzle of claim 1 that includes a pressurized source of liquid comprising water.

20. The nozzle of claim 1 that includes a pressurized source of liquid comprising water and foam concentrate and means for communicating said liquid with said barrel inlet.

21. The nozzle of claim 1 including an outer sleeve received for sliding reciprocation over said barrel.

22. The nozzle of claim 1 wherein said outlet comprises a plurality of outlets distributed symmetrically around inside portions of said barrel wall.

23. The nozzle of claim 1 that includes a plurality of outlets.

24. The nozzle of claim 6 wherein said affixing means includes a stream straightener.

25. The nozzle of claim 1 further comprising a stream straightener.

26. The nozzle of claim 25 wherein said stream straightener comprises a plurality of fins attached to said nozzle.

27. A method for fighting fires comprising:

attaching an inlet of a barrel to a source of liquid;

supplying said liquid to said barrel under pressure;

educting additive fluid into a passageway located peripherally around a wall portion of said barrel;

discharging additive fluid from an outlet of said passageway proximate a discharge end of the barrel; and deflecting liquid within said barrel outwardly to intersect discharged additive with the outwardly deflected liquid path.

28. The method of claim 27 further comprising the step of creating a reduced pressure region adjacent the additive fluid outlet.

* * * * *

UNITED STATES PATENT AND TRADEMARK OFFICE

CERTIFICATE OF CORRECTION

PATENT NO. : 5,779,159

DATED : JULY 14, 1998

INVENTOR(S): LESLIE P. WILLIAMS

It is certified that error appears in the above-identified patent and that said Letters Patent is hereby corrected as shown below:

IN THE DRAWINGS:
FIG. 1 OF SHEET 1 SHOULD APPEAR AS IN ATTACHED FIG. 1;
FIG. 2A OF SHEET 2 SHOULD APPEAR AS IN ATTACHED FIG. 2;
FIG. 3B OF SHEET 3 SHOULD APPEAR AS IN ATTACHED FIG. 3B; AND
FIG. 5 OF SHEET 5 SHOULD APPEAR AS IN ATTACHED FIG. 5.
IN COLUMN 4, LINE 4, DELETE "SF", AND REPLACE WITH - - FS - -.

Signed and Sealed this

Tenth Day of November 1998

Bruce Lehman

*Attest:*

BRUCE LEHMAN

*Attesting Officer*

*Commissioner of Patents and Trademarks*

1/5

2/5

5/5